US010371132B2

(12) United States Patent
Turner et al.

(10) Patent No.: US 10,371,132 B2
(45) Date of Patent: Aug. 6, 2019

(54) RECIPROCATING PUMP AND TRANSMISSION ASSEMBLY HAVING A ONE-WAY CLUTCH

(71) Applicant: PEOPLEFLO MANUFACTURING, INC., Franklin Park, IL (US)

(72) Inventors: Daniel T. Turner, Villa Park, IL (US); William R. Blankemeier, Oak Park, IL (US); Clark J. Shafer, Bolingbrook, IL (US)

(73) Assignee: PEOPLEFLO MANUFACTURING, INC., Franklin Park, IL (US)

( * ) Notice: Subject to any disclaimer, the term of this patent is extended or adjusted under 35 U.S.C. 154(b) by 435 days.

(21) Appl. No.: 15/430,149

(22) Filed: Feb. 10, 2017

(65) Prior Publication Data

US 2018/0230979 A1 Aug. 16, 2018

(51) Int. Cl.

| | |
|---|---|
| ***F04B 43/02*** | (2006.01) |
| ***F04B 9/04*** | (2006.01) |
| ***F04B 43/04*** | (2006.01) |
| ***F04B 17/03*** | (2006.01) |
| ***F04B 19/22*** | (2006.01) |

(52) U.S. Cl.

CPC ..... *F04B 9/042* (2013.01); *F04B 9/045* (2013.01); *F04B 17/03* (2013.01); *F04B 19/22* (2013.01); *F04B 43/026* (2013.01); *F04B 43/04* (2013.01)

(58) Field of Classification Search

CPC .. F04B 9/04; F04B 9/042; F04B 9/047; F04B 13/00; F04B 1/02; F04B 7/0266; F04B 17/03; F04B 27/02; F04B 27/055; F04B 35/04; F04B 53/006; F04B 45/043; F04B 45/047; F04B 43/025; F04B 43/026; F04B 43/04; F04B 49/20; F16D 41/00–36

USPC ..... 74/63–83, 25–47, 600

See application file for complete search history.

(56) References Cited

U.S. PATENT DOCUMENTS

| | | | |
|---|---|---|---|
| 2,031,609 | A | 2/1936 | Logue |
| 2,357,872 | A | 9/1944 | Bousman |
| 2,694,896 | A | 11/1954 | Winslow et al. |
| 2,737,896 | A | 3/1956 | Neyer |
| 2,919,650 | A | 1/1960 | Wiggermann |
| 3,149,572 | A | 9/1964 | Davis |
| 3,164,024 | A | 1/1965 | Tarry et al. |
| 3,256,824 | A | 6/1966 | Sebardt |

(Continued)

FOREIGN PATENT DOCUMENTS

| | | |
|---|---|---|
| EP | 0207212 A1 | 1/1987 |

*Primary Examiner* — Charles G Freay
*Assistant Examiner* — Thomas Fink
(74) *Attorney, Agent, or Firm* — Cook Alex Ltd.

(57) ABSTRACT

A reciprocating pump and transmission assembly having a one-way clutch is disclosed. The transmission includes an input shaft with an eccentric element, a drive link rotatably connected at one end to the eccentric element and at the other to a driven arm. The driven arm is connected to a driven shaft via a one-way clutch. The oscillating motion of the eccentric drives the drive link and driven arm and the one-way clutch translates that motion into incremental motion of the driven shaft. By changing the stroke length of the drive link various gear ratios between the drive shaft and driven shaft are achieved. The driven shaft then uses a mechanism such as a Scotch Yoke to create reciprocating motion to drive one or more pumping elements.

20 Claims, 7 Drawing Sheets

(56) References Cited

U.S. PATENT DOCUMENTS 3,646,822 A * 3/1972 Pocaterra ..... F16H 29/08 74/53
3,657,933 A 4/1972 Wagner
3,742,780 A 7/1973 Weston
3,797,969 A * 3/1974 Weatherhead ..... F04B 27/02 417/273
3,834,839 A 9/1974 Krebs et al.
4,263,825 A * 4/1981 Guslits ..... F04B 49/12 74/127
4,436,163 A * 3/1984 Simpson ..... A01G 3/053 173/109
4,818,191 A 4/1989 Schlake
4,925,370 A 5/1990 Tallarita
5,638,936 A * 6/1997 Kinoshita ..... F16D 41/07 192/113.32
5,649,809 A * 7/1997 Stapelfeldt ..... F04B 9/045 417/413.1
5,779,014 A * 7/1998 Kinoshita ..... F16D 41/07 188/82.8
5,839,888 A 11/1998 Harrison
5,865,070 A * 2/1999 Bornhorst ..... F16C 3/06 100/257
6,349,694 B1 * 2/2002 Babington ..... F01B 9/026 123/197.1
6,439,071 B2 * 8/2002 Bermudez Perez .... F16H 35/02 271/268
6,801,960 B1 10/2004 Ericson et al.
6,824,364 B2 11/2004 Ross et al.
7,549,847 B1 6/2009 McClatchey
8,425,208 B2 4/2013 McCourt
8,474,365 B2 7/2013 Kaufmann et al.
8,567,270 B1 * 10/2013 Pileeki ..... F16H 21/22 74/45
10,054,034 B1 * 8/2018 Weland ..... F02B 19/06
2001/0001372 A1 * 5/2001 Park ..... F16H 29/08 74/125.5
2007/0200468 A1 * 8/2007 Heim ..... F04B 43/0054 310/311
2009/0107442 A1 * 4/2009 Ma ..... F02M 39/02 123/179.17
2011/0031084 A1 * 2/2011 Tomlinson ..... F16D 3/68 192/45.017
2011/0198887 A1 * 8/2011 Rabhi ..... F02B 33/22 296/193.01
2013/0261595 A1 10/2013 Roe
2013/0327206 A1 * 12/2013 Rafalski, Jr. ..... F01B 25/14 91/39
2014/0137676 A1 5/2014 Han
2015/0078932 A1 * 3/2015 Ruiz Martinez ..... F01B 1/08 417/341
2015/0098837 A1 * 4/2015 Seith ..... F04B 9/045 417/42
2015/0167820 A1 * 6/2015 Hedman ..... F16H 3/0915 74/404
2015/0226205 A1 8/2015 Hines et al.
2015/0226206 A1 8/2015 Hines et al.
2015/0226207 A1 * 8/2015 Hines ..... F04B 17/044 417/374
2017/0089428 A1 * 3/2017 Olyaei ..... F16H 29/22
2018/0372087 A1 * 12/2018 Hebrard ..... F04B 35/04

* cited by examiner

Figure 8
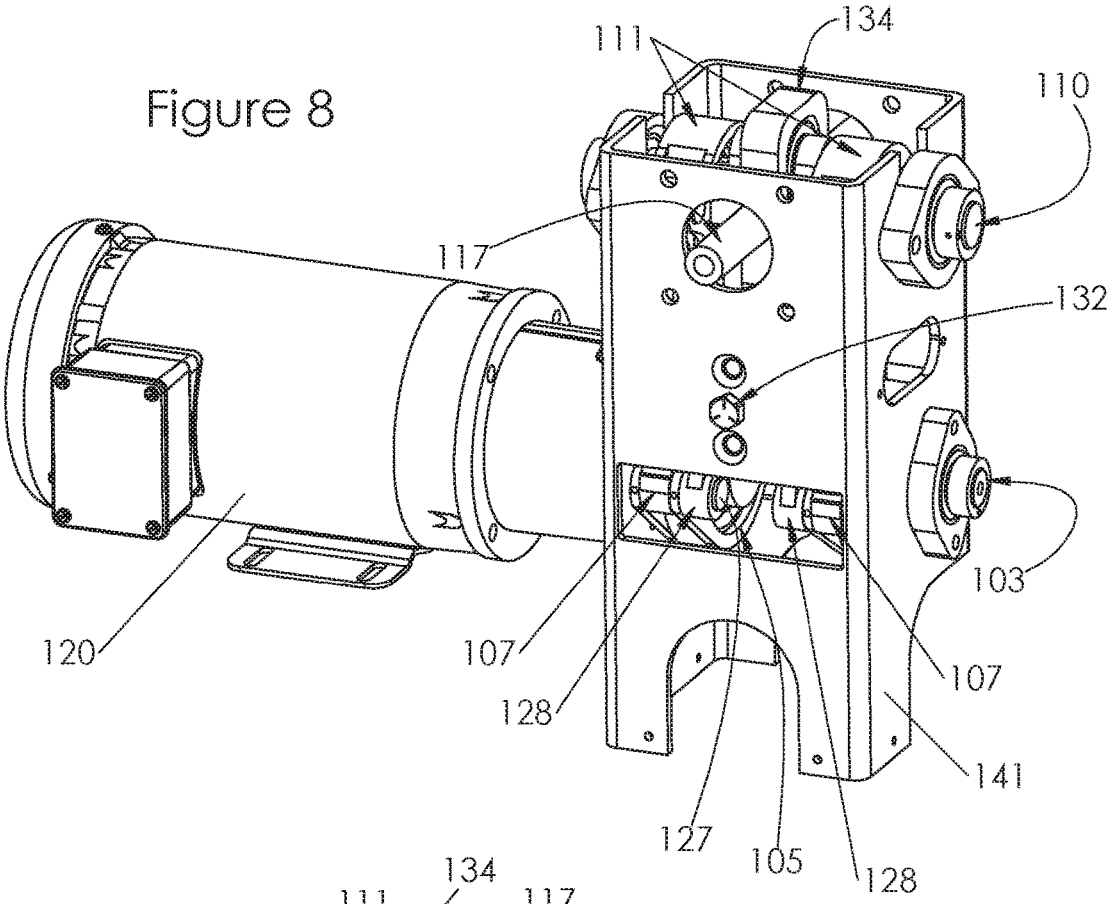
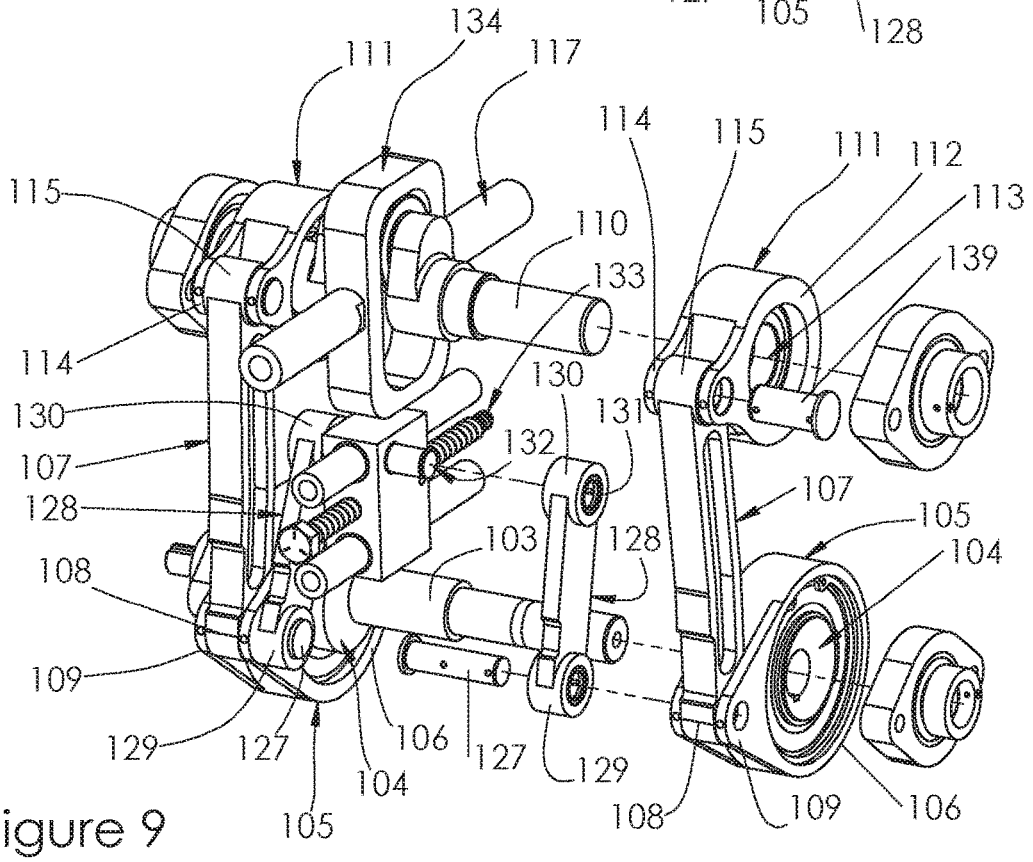
Figure 9

RECIPROCATING PUMP AND TRANSMISSION ASSEMBLY HAVING A ONE-WAY CLUTCH

BACKGROUND OF THE INVENTION

The present invention relates generally to reciprocating pumps, and more specifically to reciprocating pumps having a transmission.

Electrically driven reciprocating pumps are well known in the art. They generally have an electric motor connected to a gear box which, in turn, is connected to a mechanism in the pump that converts the rotational motion into reciprocating motion. Depending on the potential output of the electric motor and the torque required for the pumping operation, a gearbox may be needed. For instance, a gearbox may permit a high speed, low torque input of an electric motor to be converted into a low speed high torque output for the pump.

Such a gearbox generally uses gears in a heavy, large, cast gearbox assembly, with the gears requiring constant lubrication. The gearbox needs to be large because the step down in speed from the shaft of the electric motor to the pump shaft is significant, in the range of 10:1 to 90:1. This requires multiple sets of gears of varying sizes to achieve the speed reduction. The very heavy and large assembly not only creates packaging issues, but also introduces maintenance concerns. For instance, the oil in such a gear box deteriorates over time. As a result, the gearbox oil must be monitored and serviced periodically.

Another problem with such typical gearboxes is adjusting output speed. The most common way to adjust output speed is to use a variable speed drive (VSD) to control the motor speed. This is functional, but forces the motor to operate off its peak efficiency when run at slower speeds. Combined with the fixed gear ratio in the gearbox, this limits the range of speeds at which the pump can operate. The VSD also may cause problems by inducing harmonic distortions in the electrical circuit it is tied into, it can create heat that needs to be dissipated, and which can be expensive. One potential solution is to remove the VSD altogether and to use a transmission between the motor and the pump. This would allow the motor to rotate at an efficient speed, but turning the gearbox into a transmission with multiple gear ratios would multiply the number of gears used as well as the size, weight and cost, creating still further disadvantages.

A traditional prior art one-way clutch transmission removes all the gears and requirements for heavy parts as well as adding the ability continuously change gear ratios. This allows the output speed of the transmission to be very accurately set without changing the motor speed. The drawback is that this type of transmission utilizes a significant number of linkages to achieve the same output as a geared transmission. All the linkages in the transmission transmit forces through pivoting joints that need to be lubricated and will ultimately need to be replaced.

The present invention addresses shortcomings in the prior art by providing an inexpensive, relatively maintenance free, transmission that is integrated into a reciprocating pump without using gears.

SUMMARY OF THE INVENTION

The disadvantages of the prior art are overcome by example one-way clutch transmissions that are integrated into reciprocating pump assemblies of the present disclosure. The example transmissions can utilize lubricated and sealed bearings and one-way clutches that generally remove the need for maintenance. A perfectly continuous rotation of the driven shaft is not required in a pump, so a greatly simplified version of a one-way clutch transmission may be utilized. This simplified version dramatically reduces the number of parts and pivot joints relative to a traditional one-way clutch transmission. The utilization of lightweight parts also produces a significantly lighter transmission than the prior art gearboxes and remove the need to use a VSD.

In a first aspect, the disclosure provides a reciprocating pump and transmission assembly having a one-way clutch. The assembly includes a reciprocating pumping element, a rotatable input shaft, an eccentric drive member connected to the input shaft, a drive arm rotatably connected at a first end to the eccentric drive member, a drive link having a first end connected to a second end of the drive arm, a rotatable driven shaft spaced apart a first distance from the rotatable input shaft, and a driven arm rotatably connected to the rotatable driven shaft by a one-way clutch and connected to a second end of the drive link. The rotation of the input shaft at a first rotational speed rotates the eccentric drive member, and rotation of the eccentric drive member then imparts a reciprocating motion to the drive arm, wherein the reciprocating motion of the drive arm drives the drive link and driven arm which incrementally advances the one-way clutch so as to rotate the driven shaft at a second rotational speed that is slower than a first rotational speed of the input shaft.

In one example embodiment, the amount of eccentricity in the eccentric member can be adjusted, so as to change the stroke length of the drive arm. The input shaft speed is fixed, so a change is stroke length results in a change in output speed of the pump. In another embodiment the stroke length is changed by a linkage with an adjustable pivot.

Independently of how the stroke length is adjusted the oscillating motion of the drive arm is translated into rotational motion via a one-way clutch. The clutch allows torque to be transmitted in one direction; as the drive arm pulls, torque is transmitted to the driven shaft, but when it pushes, the clutch free spins back to the top of the stroke. This results in incremental advancement of the driven shaft. The driven shaft now is operating at a low speed but with a high torque and is used to drive a mechanism, such as a Scotch Yoke, that drives the reciprocating pumping element. It will be appreciated that the driving force could alternatively be transmitted when pushing as opposed to when pulling.

It is to be understood that both the foregoing general description and the following detailed description are exemplary and provided for the purpose of explanation only, and are not restrictive of the subject matter claimed. Further features and objects of the present disclosure will become more fully apparent in the following description of the preferred embodiments and from the appended claims.

BRIEF DESCRIPTION OF THE DRAWINGS

In describing the preferred example embodiments, reference is made to the accompanying drawing figures wherein like parts have like reference numerals, and wherein:

FIG. 8 is a side perspective view that shows portions of the assembly of FIG. 6 for improved viewing of certain components.

FIG. 9 is a partially exploded view that shows operative parts of the second example embodiment of the transmission having a one-way clutch.

Figure 1:
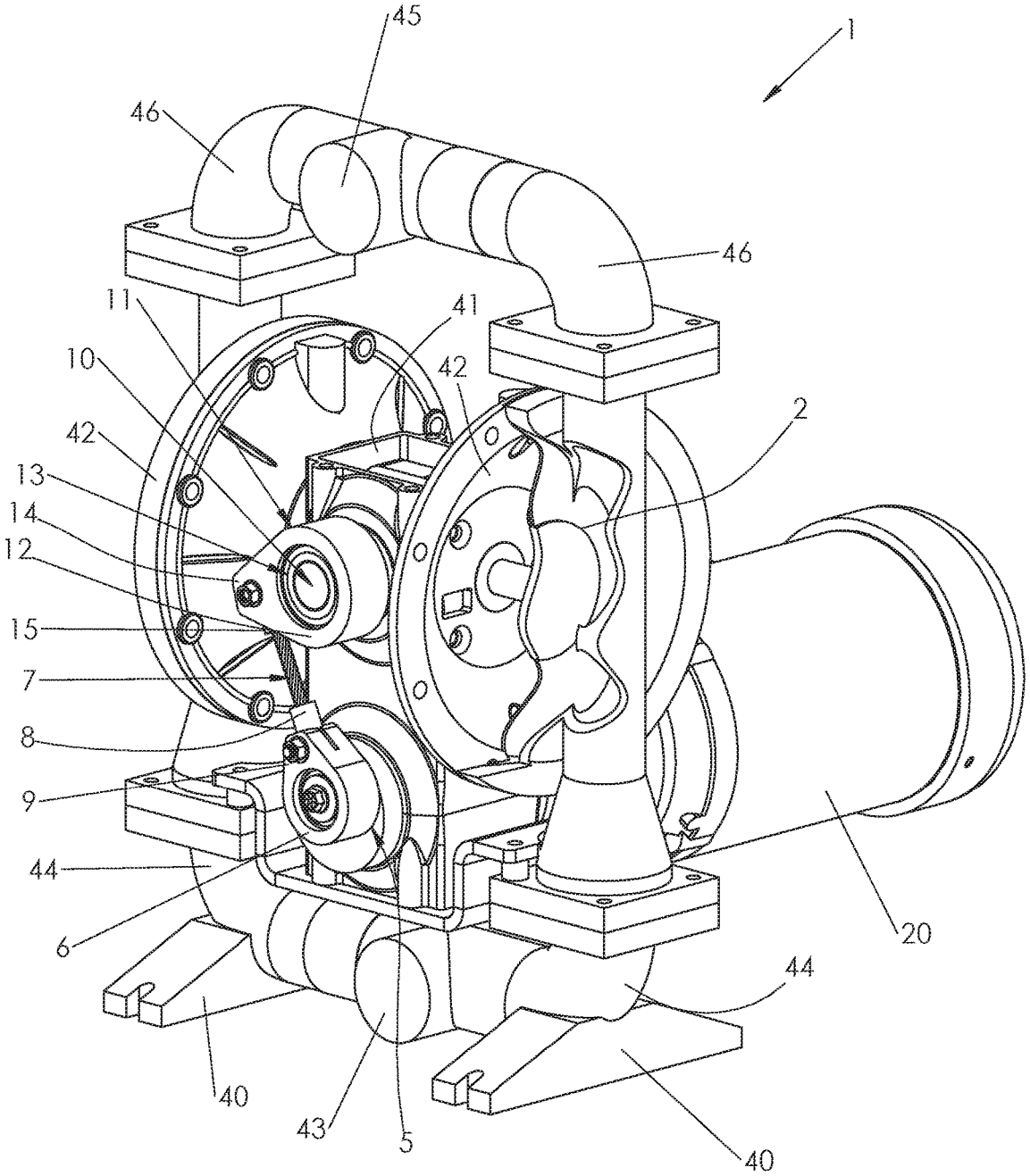
FIG. 1 is a front perspective view with a cut away that shows a first example reciprocating pump and transmission assembly having a one-way clutch in a configuration of a double diaphragm pump that is driven by an electric motor.
Figure 2:
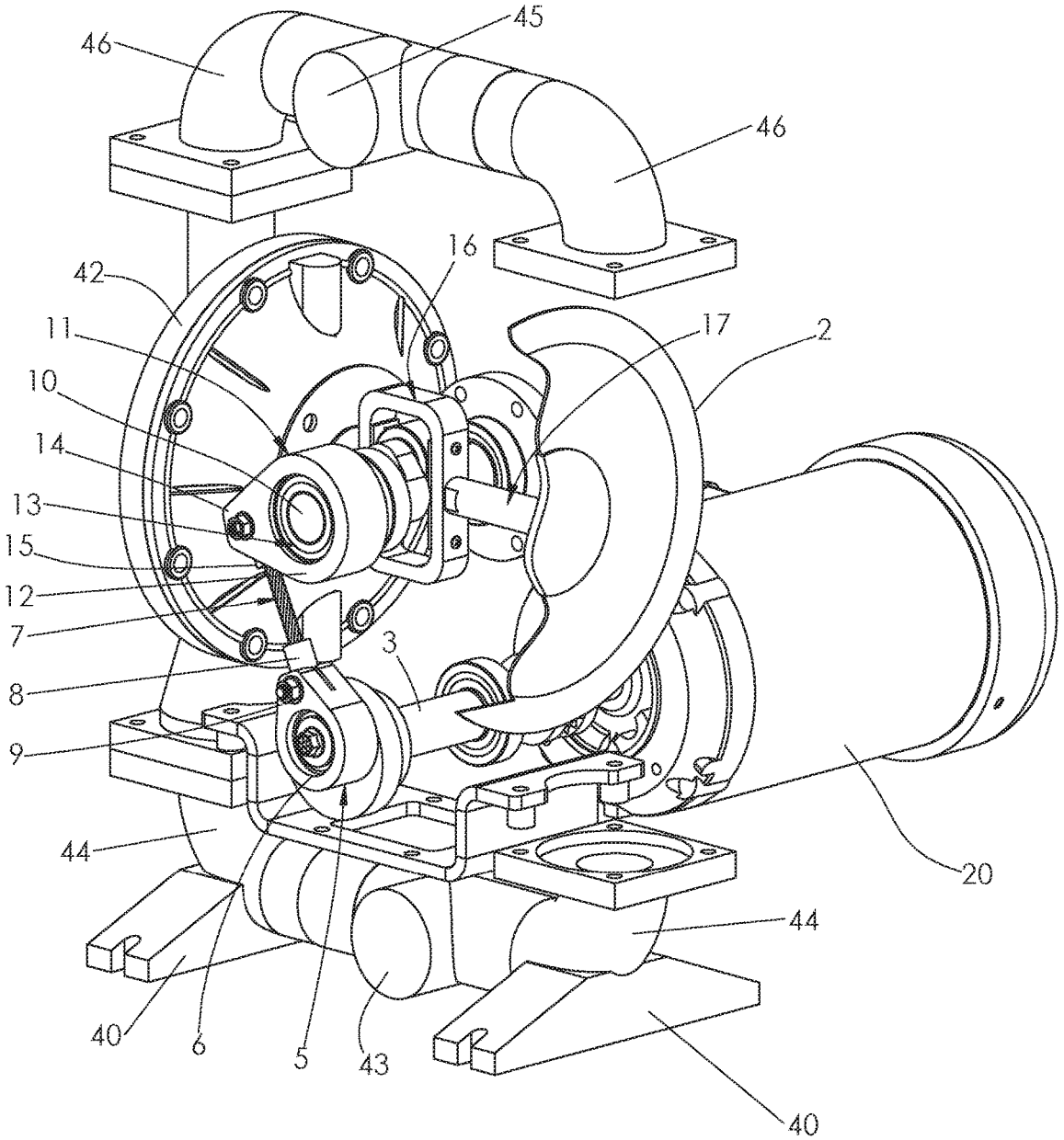
FIG. 2 is a front perspective view that shows portions of the assembly in FIG. 1 for improved viewing of certain components.
Figure 3:
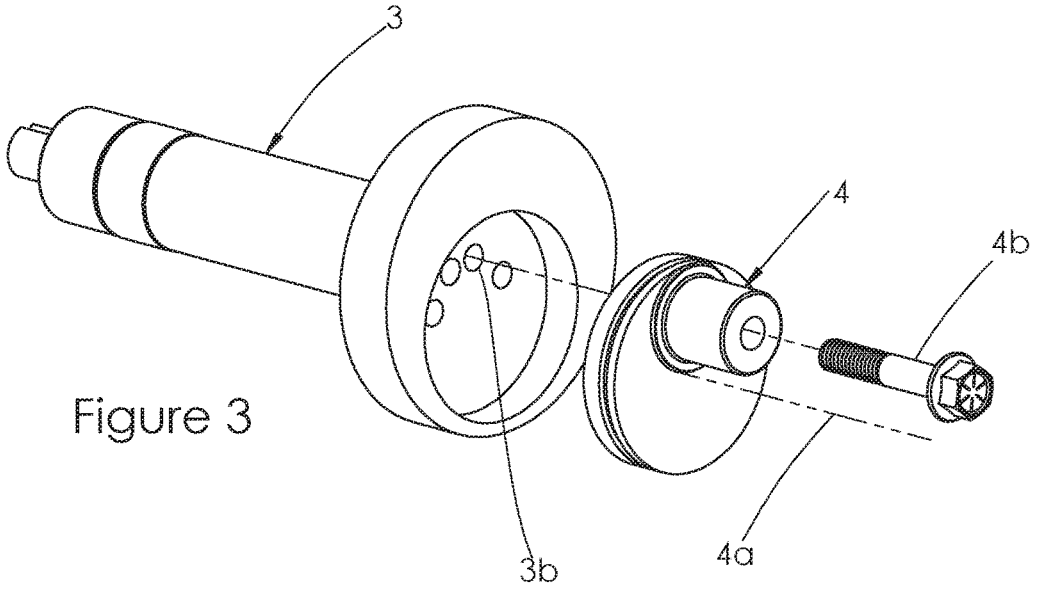
FIG. 3 is an exploded perspective view that shows an input shaft with an eccentric drive member of the assembly in FIG. 1.

It should be understood that the drawings are not to scale. While some mechanical details of the example reciprocating pump and transmission assemblies having a one-way clutch, including details of fastening means and other plan and section views of the particular components, may not have been shown, such details are considered to be within the comprehension of those skilled in the art in light of the present disclosure. It also should be understood that the present disclosure and claims are not limited to the preferred embodiments illustrated.

DETAILED DESCRIPTION OF PREFERRED EMBODIMENTS

Referring generally to FIGS. 1-11, it will be appreciated that reciprocating pump and transmission assemblies having a one-way clutch consistent with the present disclosure generally may be embodied within numerous configurations. Indeed, the teachings within this disclosure may pertain to one-way clutch transmissions for integration into a variety of types of reciprocating pump.

For instance, FIGS. 1-6 illustrate a first example embodiment of a reciprocating pump and transmission assembly having a one-way clutch 1, which is shown in a first configuration as a double diaphragm pump. In this first example, the double diaphragm pump 1 includes a reciprocating pumping element 2 seen in the cut away, a rotatable input shaft 3, an eccentric drive member 4 connected to the input shaft 3, a drive arm 5 rotatably connected at a first end 6 to the eccentric drive member 4 and a drive link 7 having a first end 8 connected to a second end 9 of the drive arm 5. A rotatable driven shaft 10 is spaced apart a first distance from the rotatable input shaft 3, and a driven arm 11 is rotatably connected at a first end 12 to the rotatable driven shaft 10 by a one-way clutch 13 and connected at a second end 14 of the driven arm 11 to a second end 15 of the drive link 7. The rotation of the input shaft 3 at a first rotational speed rotates the eccentric drive member 4 and imparts a reciprocating motion to the drive arm 5. It will be appreciated that with respect to the rotatable input shaft being connected to an eccentric drive member, the term connected is intended to include separate components that are coupled to each other, as well as an integral, single-piece component that includes a portion that serves as a rotatable input shaft and a portion that serves as an eccentric drive member. Similarly, with respect to the drive arm being connected to the drive link, the term connected is intended to include separate components that are coupled to each other, as well as an integral, single-piece component that includes a portion that serves as the drive arm and a portion that serves as the drive link, and in which case the opposite end of the drive link would be pivotally connected to the driven arm.

This reciprocating motion drives the drive link 7 and driven arm 11 which incrementally advances the one-way clutch 13 so as to rotate driven shaft 10 at a second rotational speed that is slower than the first rotational speed of the input shaft 3.

In this embodiment the driven shaft 10 is a crankshaft that drives a Scotch Yoke mechanism 16. A pair of diaphragm shafts 17 extended from either side of the Scotch yoke 16 and each is connected to a reciprocating pumping element 2, such as a diaphragm. The rotation of the driven shaft 10 creates the reciprocating motion via the Scotch Yoke 16, which effectively drives the pump.

Figure 4:
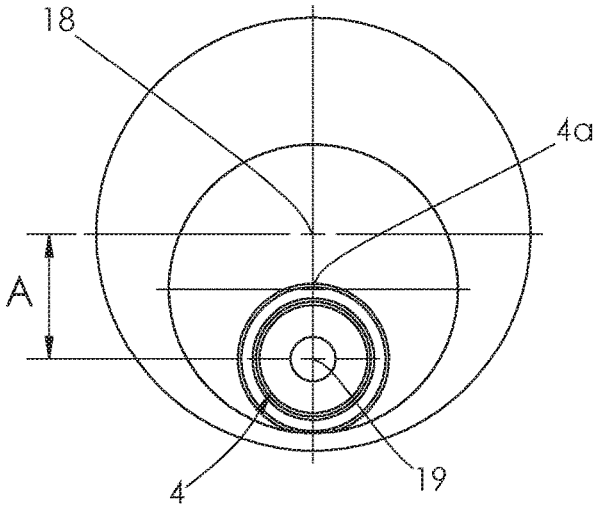
FIG. 4 is a front view of the eccentric drive member that shows the maximum amount of eccentricity that can be achieved with the eccentric drive member of FIG. 3.
Figure 5:
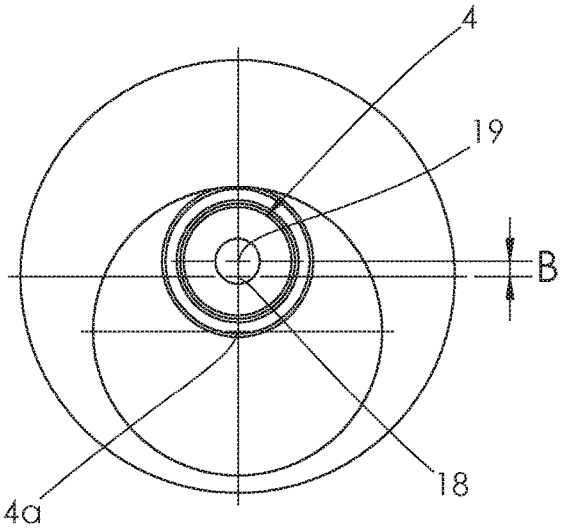
FIG. 5 is a further front view of the eccentric drive member that shows the minimum amount of eccentricity that can be achieved with the eccentric drive member of FIG. 3.

Another feature of this embodiment is that the rotational position of the eccentric drive member 4 can be set relative to input shaft 3 to select different amounts of eccentricity. As may be seen from FIG. 3, this is accomplished by insertion of a fastener **4*b* of the eccentric drive member 4 into one of a plurality of bores 3*b* in the rotatable input shaft 3. An axis of rotation 4*a* is set a first distance from the axis of rotation 18 of the rotatable shaft 3 and is set a second distance from the axis of rotation 19 of the drive arm 5, such that a specific eccentricity from the axis of rotation 18 of the input shaft 3 can be selected. The FIGS. 4 and 5 illustrate two extremes of the eccentric offset. FIG. 4 shows the amount of eccentricity A between the axis of rotation 18 of the rotatable input shaft 3 and the axis of rotation 19 of the drive arm 5. In FIG. 5 the eccentric drive member 4 has been rotated 180° on adjustment axis 4*a* and the amount of eccentricity B between the axis of rotation 18 of the rotatable input shaft 3 and the axis of rotation 19 of the drive arm 5 is shown, where B<A. The eccentricity could be adjusted over a range of positions to select eccentricities between A and B, giving the user an ability to set a precise pump speed. This variability in eccentricity would not be present if using an integral, single-piece component that includes the rotatable input shaft and the eccentric drive member. It also will be appreciated that the rotatable input shaft 3 may be driven by a prime mover 20**, such as an electric motor, or other engine.

In the first embodiment shown, the first end 8 of the drive link 7 is fixedly connected to the second end 9 of the drive arm 5 and the second end 15 of the drive link 7 is fixedly connected to the second end 14 of the driven arm 11. The drive link 7 is constructed of a semi-rigid, yet somewhat flexible steel cable. During a first pulling part of the stroke, the cable is in tension and transmits torque to the driven shaft 10, but during a second part of the stroke, the steel cable of the drive link 7 is in compression pushing the driven arm 11 back to the start of the stroke. This is possible because the one-way clutch 13 does not resist the second part of the stroke, allowing the steel cable of the drive link 7 to reset it. The flexibility of the semi-rigid drive link 7 in this embodiment allows the transmission to function without the need for the extent of rotatable connections between parts that are present in prior art assemblies. This reduces wear and increases overall reliability of the transmission. It will be appreciated that the components could be configured to transmit the torque when pushing, instead of when pulling. Also, it will be appreciated that the semi-rigid drive link of this first example could be replaced by components utilizing a rigid drive link and a pivot axis, such as are shown and discussed with respect to the second example herein.

Figure 6:
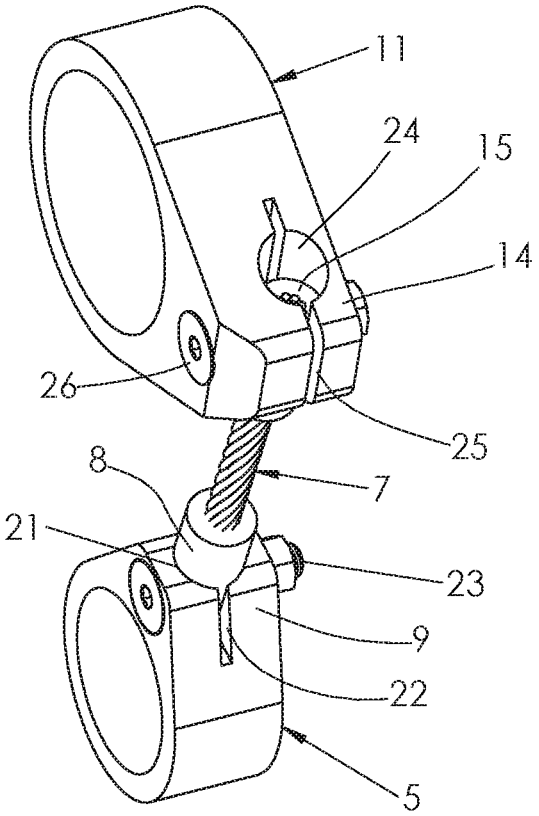
FIG. 6 is a rear perspective close up view that shows the connection between the drive arm and drive link and between the drive link and driven arm.

FIG. 6 shows a close up view of the connections associated with the drive link 7. For example, the first end 8 of the drive link 7 is received in a bore 21 in the second end 9 of the drive arm 5. The second end 9 of the drive arm 5 also includes a slot 22 that permits clamping of the first end 8 of the drive link 7 when a fastener 23 passes through an aperture in the first end 8 of the drive link 7 and is tightened. In a similar manner, the second end 15 of the drive link 7 is received in a bore 24 in the second end 14 of the driven arm 11. The second end 14 of the driven arm 11 also includes a slot 25 that permits clamping of the second end 14 of the drive link 7 when a fastener 26 passes through an aperture in the second end 14 of the drive link 7 and is tightened.

It will be appreciated that the foregoing operative components of the first example reciprocating pump and transmission assembly having a one-way clutch 1 can be employed in an example pump that may include a base 40, a transmission housing 41, at least one pumping chamber 42, at least one inlet 43 and at least one inlet conduit 44 extending between the at least one inlet 43 and the at least one pumping chamber 42, and at least one outlet 45 and at least one outlet conduit 46 extending between the at least one pumping chamber 42 and the at least one outlet 46.

Figure 7:
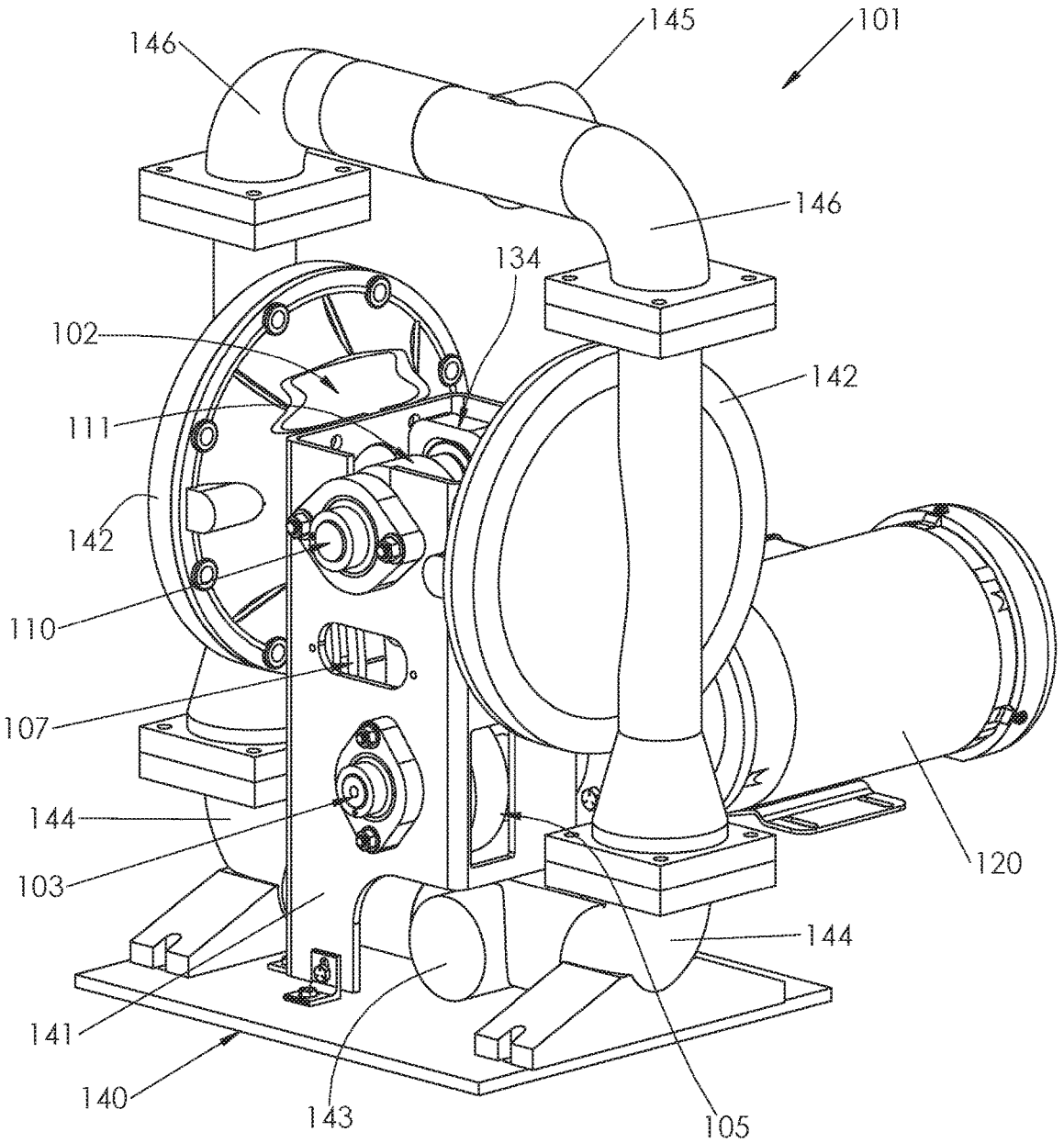
FIG. 7 is a front perspective view with a cut away that shows a second example reciprocating pump and transmission assembly having a one-way clutch in a configuration of a double diaphragm pump that is driven by an electric motor.

Turning to FIGS. 7-9, a second example embodiment of a reciprocating pump and transmission assembly having a one-way clutch 101 is illustrated within a configuration of a double diaphragm pump. In this second example, the double diaphragm pump 101 includes a reciprocating pumping element 102 seen in the cut away, a rotatable input shaft 103, an eccentric drive member 104 connected to the input shaft 103, a drive arm 105 rotatably connected at a first end 106 to the eccentric drive member 104 and a drive link 107 having a first end 108 pivotally connected to a second end 109 of the drive arm 105 at a first pivot 127. A rotatable driven shaft 110 is spaced apart a first distance from the rotatable input shaft 103, and a driven arm 111 is rotatably connected at a first end 112 to the rotatable driven shaft 110 by a one-way clutch 113 and pivotally connected at a second end 114 of the driven arm 111 to a second end 115 of the drive link 107 at a second pivot 139.

The second example reciprocating pump and transmission assembly having a one-way clutch 101 further includes a control link 128 having a first end 129 pivotally connected to the drive arm 105 at the first pivot 127 and a second end 130 pivotally connected at a second pivot 131 to a movable control pivot 132 spaced apart a second distance from the rotatable input shaft 103. The rotation of the rotatable input shaft 103 at a first rotational speed rotates the eccentric drive member 104 and imparts a reciprocating motion to the drive link 107 and driven arm 111.

This reciprocating motion drives the drive link 107 and driven arm 111, which incrementally advances the one-way clutch 113, so as to rotate driven shaft 110 at a second rotational speed that is slower than the first rotational speed of the input shaft 103. The difference between the first and second rotational speeds is determined by the second distance between the spaced apart movable control pivot 132 and the rotatable input shaft 103 and by respective effective lengths of the drive arm 105, control link 128, drive link 107 and driven arm 111.

In this second example embodiment the eccentric drive member 104, the drive arm 105, the one-way clutch 113, the control link 128, the drive link 107, and the driven arm 111 collectively form a set of drive components, and the reciprocating pump further comprises two of these sets of drive components. Furthermore, each set of drive components has individual different driving phases spaced 180° apart that are complementary to the other set of drive components. The plurality of sets of drive components together provide multiple incrementally advancing inputs to the driven shaft 110. It will be appreciated that a plurality of sets of drive components may enable smoother incremental operation, and there may be two or more sets of drive components. It also will be appreciated that, as with the rotatable input shaft 3 of the first example, the rotatable input shaft 103 of the second example may be driven by a prime mover 120, such as an electric motor, or other engine.

The second example reciprocating pump and transmission assembly having a one-way clutch 101 further includes a worm gear 133 that is connected to the movable control pivot 132 and is used to move the movable control pivot 132 linearly from the second distance between the spaced apart movable control pivot 132 and the rotatable input shaft 103 to a third distance between the spaced apart movable control pivot 132 and the rotatable input shaft 103. This changing of the second distance between the movable control pivot 132 and the rotatable input shaft 103 changes the ratio of the first rotational speed of the rotatable input shaft 103 to the second rotational speed of the driven shaft 110 by moving the location of the second pivot. The ability to change the ratio is continuous and as such, a user has precise control of the final pump reciprocating speed.

In this example embodiment, the driven shaft 110 is a crankshaft that drives a Scotch Yoke mechanism 134. A pair of diaphragm shafts 117 extend from either side of the yoke mechanism 134 and connect to the reciprocating pumping elements 102, in the form of diaphragms. The rotation of the driven shaft 110 creates the reciprocating motion via the Scotch Yoke mechanism 134, which causes the pumping action.

It will be appreciated that the foregoing operative components of the second example reciprocating pump and transmission assembly having a one-way clutch 101 can be employed in an example pump that may include a base 140, a transmission housing 141, at least one pumping chamber 142, at least one inlet 143 and at least one inlet conduit 144 extending between the at least one inlet 143 and the at least one pumping chamber 142, and at least one outlet 145 and at least one outlet conduit 146 extending between the at least one pumping chamber 142 and the at least one outlet 146.

Figure 10:
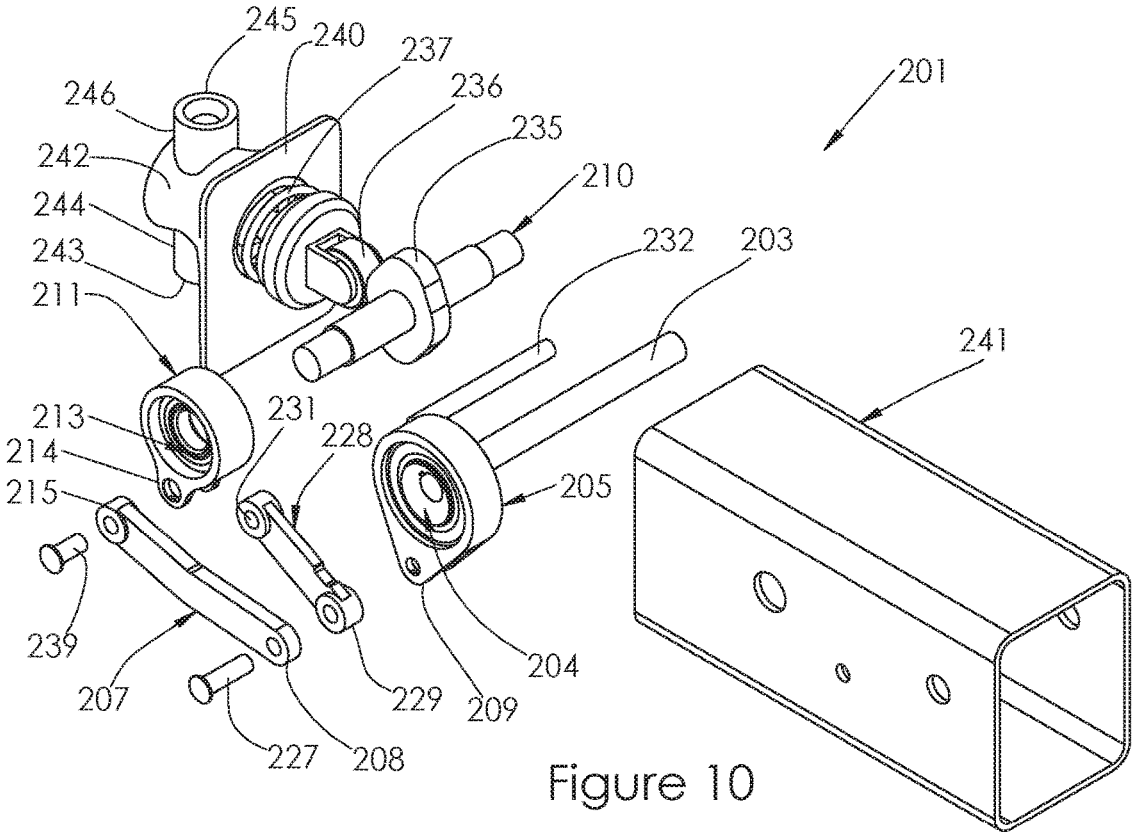
FIG. 10 is a partially exploded view that shows operative parts of a third example reciprocating pump and transmission assembly having a one-way clutch in a configuration of a piston pump.
Figure 11:
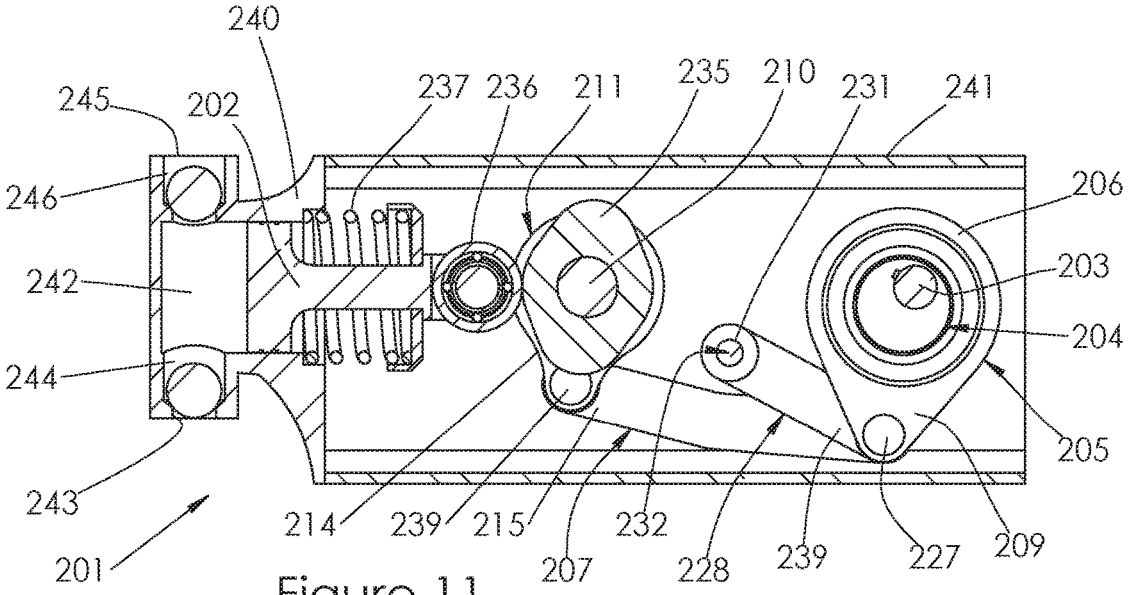
FIG. 11 is a side cross-sectional view that shows the piston pump of FIG. 10.

Turning to FIGS. 10 and 11, a third example embodiment of a reciprocating pump and transmission assembly having a one-way clutch 201 is illustrated within a configuration of a piston pump. The piston pump 201 includes a reciprocating pumping element 202, a rotatable input shaft 203, an eccentric drive member 204 connected to the rotatable input shaft 203, a drive arm 205 rotatably connected at a first end 206 to the eccentric drive member 204 and a drive link 207 having a first end 208 pivotally connected at a first pivot 227 to a second end 209 of the drive arm 205. A rotatable driven shaft 210 is spaced apart a first distance from the rotatable input shaft 203, and a driven arm 211 is rotatably connected to the rotatable driven shaft 210 by a one-way clutch 213 and pivotally connected at a second end 214 of the driven arm 211 to a second end 215 of the drive link 207 at a second pivot 239.

There is a control link 228 having a first end 229 pivotally connected to the drive arm 205 at the first pivot 227 and pivotally connected at a second pivot 231 to a fixed control pivot 232 spaced apart a second distance from the rotatable input shaft 203. The rotation of the rotatable input shaft 203 at a first rotational speed rotates the eccentric drive member 204 and imparts a reciprocating motion to the drive arm 205 and control link 228. This reciprocating motion drives the drive link 207 and driven arm 211 which incrementally advances the one-way clutch 213 so as to rotate driven shaft 210 at a second rotational speed that is slower than the first rotational speed of the input shaft 203. The difference between the first and second rotational speeds is determined by the second distance between the spaced apart fixed control pivot 232 and the rotatable input shaft 203 and by respective effective lengths of the drive arm 205, control link 228, drive link 207 and driven arm 211.

The driven shaft 210 then rotates a cam 235, and a cam follower 236 is biased by a biasing member 237 against the cam 235, with the biasing member 237 in the form of a spring. The cam follower 236 is rotatably connected to the pumping element 202 in the form of a piston. When the cam 235 rotates it forces the piston 202 from an original position into its compression stroke. The biasing member 237 then retracts the piston 202 back to the original position, and the stroke then repeats. The pump 201 is shown schematically within a transmission housing 241, and would be powered by a prime mover, such as the electric motor used in one of the previous examples, or other engine.

It will be appreciated that the foregoing operative components of the third reciprocating pump and transmission assembly having a one-way clutch 201 can be employed in an example pump that may include a base 240, a transmission housing 241, at least one pumping chamber 242, at least one inlet 243 and at least one inlet conduit 244 extending between the at least one inlet 243 and the at least one pumping chamber 242, and at least one outlet 245 and at least one outlet conduit 246 extending between the at least one pumping chamber 242 and the at least one outlet 246.

From the above disclosure, it will be apparent that reciprocating pump and transmission assemblies having a one-way clutch that are constructed in accordance with this disclosure may include a number of structural aspects that provide advantages over conventional pump and transmission constructions, depending upon the specific design chosen.

It will be appreciated that reciprocating pump and transmission assemblies having a one-way clutch may be embodied in various configurations with respect to the type of pump, as well as various configurations relating to the drive arm, drive link and driven arm. Any variety of suitable materials of construction, configurations, shapes and sizes for the components and methods of connecting the components may be utilized to meet the particular needs and requirements of an end user. It will be apparent to those skilled in the art that various modifications can be made in the design and construction of such reciprocating pumps and transmission assemblies having a one-way clutch without departing from the scope or spirit of the claimed subject matter, and that the claims are not limited to the preferred embodiment illustrated herein.

The invention claimed is:

1. A reciprocating pump and transmission assembly having a one-way clutch, comprising:

a reciprocating pumping element;

a rotatable input shaft;

an eccentric drive member connected to the input shaft;

a drive arm rotatably connected at a first end to the eccentric drive member;

a drive link having a first end connected to a second end of the drive arm;

a rotatable driven shaft spaced apart a first distance from the rotatable input shaft;

a driven arm rotatably connected to the rotatable driven shaft by a one-way clutch and connected to a second end of the drive link; and wherein rotation of the input shaft at a first rotational speed rotates the eccentric drive member, and rotation of the eccentric drive member imparts a reciprocating motion to the drive arm, wherein the reciprocating motion of the drive arm drives the drive link and driven arm which incrementally advances the one-way clutch so as to rotate the driven shaft at a second rotational speed that is slower than a first rotational speed of the input shaft.

2. The reciprocating pump and transmission assembly of claim 1, further comprising the eccentric drive member having an eccentric offset distance between an axis of rotation of the input shaft and an axis of rotation of the eccentric drive member wherein the difference between the first and second rotational speeds is related to the eccentric offset distance.

3. The reciprocating pump and transmission assembly of claim 2, wherein rotation of the driven shaft moves the reciprocating pumping element.

4. The reciprocating pump and transmission assembly of claim 1, wherein the first end of the drive link is fixedly connected to the second end of the drive arm and the second end of the drive link is fixedly connected to the driven arm.

5. The reciprocating pump and transmission assembly of claim 4, wherein the drive link is semi-rigid.

6. The reciprocating pump and transmission assembly of claim 5, wherein the semi-rigid drive link further comprises steel cable.

7. The reciprocating pump and transmission assembly of claim 1, wherein the first end of the drive link is pivotally connected to the second end of the drive arm and the second end of the drive link is pivotally connected to the driven arm, with the pump further comprising:

a control link having a first end pivotally connected to the drive arm at a first pivot;

a movable control pivot spaced apart a second distance from the rotatable input shaft and being pivotally connected to a second end of the control link at a second pivot;

the first end of the drive link being pivotally connected to the drive arm at the first pivot; and wherein the difference between the first and second rotational speeds is determined by the second distance between the spaced apart movable control pivot and the rotatable input shaft and by respective effective lengths of the drive arm, control link, drive link and driven arm, and wherein rotation of the driven shaft moves the reciprocating pumping element.

8. The reciprocating pump and transmission assembly of claim 7, wherein the eccentric drive member, the drive arm, the one-way clutch, the control link, the drive link, and the driven arm collectively form a set of drive components, and the pump further comprises a plurality of sets of drive components.

9. The reciprocating pump and transmission assembly of claim 8, wherein each of the sets of drive components has individual different driving phases that are complementary to the other sets of drive components and the plurality of sets of drive components together provide multiple incrementally advancing inputs to the driven shaft.

10. The reciprocating pump and transmission assembly of claim 7, wherein changing the second distance between the spaced apart movable control pivot and the input shaft changes the ratio of first rotational speed of the input shaft to second rotational speed of the driven shaft.

11. The reciprocating pump and transmission assembly of claim 7, wherein a worm gear is connected to the movable control pivot and is used to move the movable control pivot from the second distance between the spaced apart movable control pivot and the input shaft to a different distance between the spaced apart movable control pivot and the input shaft.

12. The reciprocating pump and transmission assembly of claim 11, wherein the worm gear moves the moveable control pivot linearly.

13. The reciprocating pump and transmission assembly of claim 1, wherein the rotatable input shaft is driven by a prime mover.

14. The reciprocating pump and transmission assembly of claim 13, wherein the prime mover further comprises an electric motor.

15. The reciprocating pump and transmission assembly of claim 1, wherein the reciprocating pumping element further comprises a diaphragm or a piston.

16. The reciprocating pump and transmission assembly of claim 1, wherein the driven shaft further comprises a reciprocating mechanism that moves the reciprocating pumping element.

17. The reciprocating pump and transmission assembly of claim 16, wherein the reciprocating mechanism further comprises a cam.

18. The reciprocating pump and transmission assembly of claim 17, wherein the reciprocating pumping element is driven by the cam and a spring biases the reciprocating pumping element against the cam.

19. The reciprocating pump and transmission assembly of claim 17, wherein the reciprocating mechanism further comprises a crank shaft.

20. The reciprocating pump and transmission assembly of claim 19, wherein the crank shaft drives a Scotch yoke mechanism.

* * * * *